US011198534B2

(12) United States Patent
Kastanek et al.

(10) Patent No.: US 11,198,534 B2
(45) Date of Patent: Dec. 14, 2021

(54) REINFORCED PACKAGE

(71) Applicant: Graphic Packaging International, LLC, Atlanta, GA (US)

(72) Inventors: Raymond S. Kastanek, Mead, CO (US); Kelly R. Fitzwater, Lakewood, CO (US)

(73) Assignee: Graphic Packaging International, LLC, Atlanta, GA (US)

( * ) Notice: Subject to any disclaimer, the term of this patent is extended or adjusted under 35 U.S.C. 154(b) by 0 days.

(21) Appl. No.: 16/751,761

(22) Filed: Jan. 24, 2020

(65) Prior Publication Data

US 2020/0239184 A1 Jul. 30, 2020

Related U.S. Application Data

(60) Provisional application No. 62/797,560, filed on Jan. 28, 2019.

(51) Int. Cl.
*B65D 5/44* (2006.01)
*B65D 5/02* (2006.01)
(Continued)

(52) U.S. Cl.
CPC ..... *B65D 5/445* (2013.01); *B65D 5/0209* (2013.01); *B65D 5/029* (2013.01); *B65D 5/0281* (2013.01); *B65D 5/4266* (2013.01); *B65D 77/04* (2013.01)

(58) Field of Classification Search
CPC .... B65D 5/445; B65D 5/0209; B65D 5/0281; B65D 5/029; B65D 5/4266; B65D 77/04;
(Continued)

(56) References Cited

U.S. PATENT DOCUMENTS 1,474,088 A 11/1923 Reynolds
1,516,090 A 11/1924 Gary et al.
(Continued)

FOREIGN PATENT DOCUMENTS

CA 2 384 311 3/2001
CA 2 586 472 5/2006
(Continued)

OTHER PUBLICATIONS

International Search Report and Written Opinion for PCT/US2020/014939 dated May 22, 2020.

*Primary Examiner* — Christopher R Demeree
(74) *Attorney, Agent, or Firm* — Womble Bond Dickinson (US) LLP

(57) ABSTRACT

A reinforced package comprising a carton comprising a plurality of panels that extends at least partially around an interior of the carton. The plurality of panels can comprise a front panel and a back panel disposed opposite to the front panel. The carton can comprise a bottom wall foldably connected to the front panel along a first curved fold line and to the back panel along a second curved fold line. The reinforced package further can include a bag at least partially attached to the carton. The bag can be at least partially defining an interior space for holding a product. The carton can be positionable in a non-erect position and in an erect position. At least the bottom wall and the first curved fold line can be configured to retain the carton in the erect position.

33 Claims, 9 Drawing Sheets

(51) Int. Cl.
*B65D 77/04* (2006.01)
*B65D 5/42* (2006.01)

(58) Field of Classification Search
CPC ..... B65D 33/02; B65D 5/606; B65D 5/3621; B65D 75/008; B65D 75/525
USPC ..... 229/199, 117.32, 117.06, 117.33, 108.1, 229/117.27; 383/104
See application file for complete search history.

(56) References Cited

U.S. PATENT DOCUMENTS 1,664,111 A 3/1928 Johnson
2,092,858 A 9/1937 Richard
2,095,910 A 10/1937 Bergstein
2,099,257 A * 11/1937 Bergstein ..... B65D 5/606 229/117.32
2,107,946 A 2/1938 Inman
2,114,625 A 4/1938 Bergstein
2,134,057 A 10/1938 Potdevin
2,132,966 A 11/1938 O'Brien
2,166,388 A 7/1939 Bergstein
2,197,113 A 4/1940 Piazze
2,250,249 A * 7/1941 Bergstein ..... B65D 5/606 229/117.32
2,273,470 A 2/1942 Gardner
2,282,207 A 5/1942 Palmer
2,286,465 A 6/1942 Erlin
RE23,096 E 4/1949 Mullinix
2,502,117 A 3/1950 Anderson
2,553,923 A 5/1951 Lambert
2,758,520 A 8/1956 Hepworth
2,799,211 A 7/1957 Zerlin
2,835,435 A 5/1958 Mullinix
2,870,023 A 1/1959 Vogt
2,913,161 A 11/1959 Travis
2,987,402 A 6/1961 Dold
3,104,596 A 9/1963 Bergstein
3,105,417 A 10/1963 Hammer
3,142,231 A 7/1964 Christensson
3,142,430 A 7/1964 Meyers
3,153,991 A 10/1964 Goodrich
3,194,471 A 7/1965 Murphy
3,218,961 A 11/1965 Kraft et al.
3,240,419 A 3/1966 Spiering et al.
3,249,286 A 5/1966 Palmer
3,250,454 A 5/1966 Steiger
3,272,423 A 9/1966 Bjarno
3,324,998 A 6/1967 Farquhar
3,336,846 A 8/1967 Berghgracht
3,357,631 A 12/1967 Aid et al.
3,395,623 A 8/1968 Baker
3,399,818 A * 9/1968 Stegner ..... B65D 5/60 229/117.32
3,412,925 A 11/1968 Booth
3,428,235 A 2/1969 Randazzo
3,459,357 A 8/1969 Egger et al.
3,461,642 A 8/1969 Langen et al.
3,482,758 A 12/1969 Pierre
3,515,333 A 6/1970 Kotkas et al.
3,543,469 A 12/1970 Ullman
3,552,640 A 1/1971 Young
3,554,434 A 1/1971 Anderson
3,570,751 A 3/1971 Trewella
3,575,409 A 4/1971 Calvert
3,576,290 A 4/1971 Marchisen
3,616,027 A 10/1971 Honsel
3,627,541 A 12/1971 Farquhar
3,637,130 A 1/1972 Farquhar
3,659,777 A 5/1972 Kanada et al.
3,739,545 A 6/1973 Lattke
3,800,677 A 4/1974 Jones et al.
3,878,771 A 4/1975 Malcolm
RE28,554 E 9/1975 Curler et al.
3,945,870 A 3/1976 Johnsen
3,959,950 A 6/1976 Fukuda
3,964,669 A 6/1976 Sontag et al.
3,981,494 A 9/1976 Prestegaard
4,011,983 A 3/1977 Greene
4,034,658 A 7/1977 Sherman
4,063,679 A 12/1977 Henry
4,082,216 A 4/1978 Clarke
4,164,171 A 8/1979 Meyers et al.
4,170,928 A 10/1979 Beasley
4,196,035 A 4/1980 Reil
4,228,945 A 10/1980 Wysocki
4,244,281 A 1/1981 Kauffman et al.
4,267,955 A 5/1981 Strubble
4,284,205 A 8/1981 Hirata
4,312,451 A 1/1982 Forbes, Jr.
4,313,542 A 2/1982 Roberts et al.
4,331,434 A 5/1982 Buschor
4,398,636 A 8/1983 Baxter
4,457,483 A 7/1984 Gagne
4,477,014 A 10/1984 Brandenburger
4,478,351 A 10/1984 Homma
4,484,683 A 11/1984 Werner, Jr.
4,490,960 A 1/1985 Klemesrud
4,494,785 A 1/1985 Song
4,520,615 A 6/1985 Engler
4,575,000 A 3/1986 Gordon et al.
4,577,746 A 3/1986 Tokuno et al.
4,578,929 A 4/1986 Tisma
4,582,315 A 4/1986 Scarpa et al.
4,600,346 A 7/1986 Podosek
4,605,464 A 8/1986 Slevin
4,608,259 A 8/1986 Cortopassi
4,627,223 A 12/1986 Janhonen
4,726,170 A 2/1988 Sawa et al.
4,747,703 A 5/1988 Gazes
4,754,914 A 7/1988 Wischusen, III
4,775,771 A 10/1988 Pawlowski
4,785,696 A 11/1988 Martiny
4,793,117 A 12/1988 Raudat et al.
4,802,664 A 2/1989 Larsen
4,854,983 A 8/1989 Bryniarski
4,865,921 A 9/1989 Hollenberg
4,881,934 A 11/1989 Harston et al.
4,890,439 A 1/1990 Smart
4,919,785 A 4/1990 Willey et al.
4,930,639 A 6/1990 Rigby
4,936,935 A 6/1990 Beckett
4,940,200 A 7/1990 Sawyer
4,963,424 A 10/1990 Beckett
4,986,522 A 1/1991 Paulson
4,995,217 A 2/1991 Francis, Jr.
5,014,582 A 5/1991 Teik
5,019,029 A 5/1991 Calvert
5,028,147 A 7/1991 Graham
5,034,234 A 7/1991 Andreas et al.
5,071,062 A 12/1991 Bradley et al.
5,078,273 A 1/1992 Kuchenbecker
5,080,643 A 1/1992 Mitchell et al.
5,093,364 A 3/1992 Richards
5,096,723 A 3/1992 Turpin
5,097,651 A 3/1992 Decottignies et al.
5,102,385 A 4/1992 Calvert
5,102,485 A 4/1992 Keeler et al.
5,108,355 A 4/1992 Walsh
5,117,078 A 5/1992 Beckett
5,132,124 A 7/1992 Tamaki et al.
5,154,041 A 10/1992 Schneider
5,175,404 A 12/1992 Andreas et al.
5,176,612 A 1/1993 Calvert et al.
5,199,792 A 4/1993 Roosa
5,205,651 A 4/1993 Decottignies et al.
5,207,629 A 5/1993 Walsh
5,213,902 A 5/1993 Beckett
5,221,419 A 6/1993 Beckett
5,224,919 A 7/1993 Walsh
5,242,365 A 9/1993 Counts
5,254,071 A 10/1993 Laroche
5,260,537 A 11/1993 Beckett
5,266,386 A 11/1993 Beckett

(56) References Cited

U.S. PATENT DOCUMENTS 5,282,349 A 2/1994 Siegel
5,282,528 A 2/1994 Hudson
5,326,022 A 7/1994 Green
5,330,099 A 7/1994 Beales et al.
RE34,683 E 8/1994 Maynard
5,337,951 A 8/1994 Roccaforte
5,340,436 A 8/1994 Beckett
5,346,311 A 9/1994 Siler et al.
5,354,973 A 10/1994 Beckett
5,410,135 A 4/1995 Pollart
5,411,165 A 5/1995 Ellis
5,424,517 A 6/1995 Habeger
5,427,267 A 6/1995 Willman
5,484,100 A 1/1996 Rigby
5,492,269 A 2/1996 Sung
5,510,132 A 4/1996 Gallo, Jr.
5,519,195 A 5/1996 Keefer
5,585,027 A 12/1996 Young
5,615,795 A 4/1997 Tipps
5,628,921 A 5/1997 Beckett
5,632,368 A 5/1997 Moncrief
5,653,671 A 8/1997 Reuteler
5,657,610 A 8/1997 Dietrich et al.
5,662,577 A 9/1997 Reuteler
5,672,407 A 9/1997 Beckett
5,688,427 A 11/1997 Gallo, Jr.
5,746,871 A 5/1998 Walsh
5,759,422 A 6/1998 Schmelzer
5,772,569 A 6/1998 Janhonen
5,800,724 A 9/1998 Habeger
5,845,769 A 12/1998 Yeager
5,876,319 A 3/1999 Holton
5,921,681 A * 7/1999 Money ..... B65D 5/3685 383/119
5,938,110 A 8/1999 Bernstein
5,944,183 A 8/1999 Rowland et al.
5,964,161 A 10/1999 Conway
5,997,458 A 12/1999 Guttinger et al.
6,050,063 A 4/2000 Ford et al.
6,063,415 A 5/2000 Walters
6,073,423 A 6/2000 House
6,082,613 A 7/2000 Mikulski et al.
6,114,679 A 9/2000 Lai
6,132,351 A 10/2000 Lotto et al.
6,139,662 A 10/2000 Forman
6,146,028 A 11/2000 Preszler
6,150,646 A 11/2000 Lai et al.
6,204,492 B1 3/2001 Zeng et al.
6,206,279 B1 * 3/2001 Countee ..... B65D 5/0005 229/117.27
6,213,286 B1 4/2001 Hunter et al.
6,234,384 B1 5/2001 Capy et al.
6,251,451 B1 6/2001 Zeng
6,253,993 B1 7/2001 Lloyd et al.
6,254,519 B1 7/2001 Toshima
6,311,457 B1 11/2001 May et al.
6,312,742 B1 11/2001 Wood et al.
6,332,488 B1 12/2001 Walsh
6,335,042 B1 1/2002 Money
6,349,874 B1 2/2002 Hill
6,360,941 B1 3/2002 Larsson
6,398,010 B1 6/2002 Fangmeier
6,401,927 B1 6/2002 Sorensen et al.
6,414,290 B1 7/2002 Cole
6,425,847 B1 7/2002 Broenstrup
6,431,365 B1 8/2002 Money
6,433,322 B2 8/2002 Zeng et al.
6,455,827 B2 9/2002 Zeng
6,490,843 B1 12/2002 May
6,494,619 B1 12/2002 Sulpizio
6,509,052 B1 1/2003 Benham et al.
6,550,608 B1 4/2003 Brown et al.
6,552,315 B2 4/2003 Zeng et al.
6,561,414 B1 5/2003 Cai
6,635,139 B2 10/2003 Bohn
6,637,646 B1 10/2003 Muise
6,657,165 B1 12/2003 Makutonin
6,676,583 B2 1/2004 Walsh
6,677,563 B2 1/2004 Lai
6,683,289 B2 1/2004 Whitmore et al.
6,695,202 B2 2/2004 Miess
6,702,178 B2 3/2004 Bowers et al.
6,717,121 B2 4/2004 Zeng
6,744,028 B2 6/2004 Chisholm et al.
6,765,182 B2 7/2004 Cole
6,854,639 B2 2/2005 Walsh
6,869,387 B2 3/2005 Post et al.
6,915,829 B2 7/2005 Popp
6,948,293 B1 9/2005 Eckermann
6,986,920 B2 1/2006 Forman et al.
6,993,889 B2 2/2006 Ford et al.
7,019,271 B2 3/2006 Wnek et al.
7,070,551 B2 7/2006 Lasson
7,143,930 B2 12/2006 Money et al.
7,414,230 B2 8/2008 Fitzwater
7,445,590 B2 11/2008 Selle et al.
7,461,838 B2 12/2008 Hendricks et al.
7,473,875 B2 1/2009 Fitzwater
7,509,789 B2 3/2009 Scholtes et al.
7,510,515 B2 3/2009 Ichikawa
7,604,155 B2 10/2009 Bossel et al.
7,667,167 B2 2/2010 Fitzwater
7,695,421 B2 4/2010 Ford
7,699,214 B2 4/2010 Mestre et al.
7,794,147 B2 9/2010 Perelman
7,819,583 B2 10/2010 Walker et al.
7,837,606 B2 11/2010 Tetenborg et al.
7,893,389 B2 2/2011 Fitzwater
7,913,897 B2 3/2011 Manaige
7,935,041 B2 5/2011 Graham et al.
7,938,312 B2 5/2011 Ford
7,959,060 B2 6/2011 Wilson et al.
7,982,167 B2 7/2011 Fitzwater
7,984,844 B2 7/2011 Jones
8,013,280 B2 9/2011 Robison et al.
8,024,910 B2 9/2011 Graham et al.
8,025,618 B2 9/2011 Walsh et al.
8,066,137 B2 11/2011 Sanfilippo et al.
8,142,077 B2 3/2012 Iannelli, II et al.
8,196,805 B2 6/2012 Brand et al.
8,206,033 B2 6/2012 Sato et al.
8,226,794 B2 7/2012 Fogle
8,309,896 B2 11/2012 Fitzwater
8,317,671 B1 11/2012 Zoeckler
8,323,165 B2 12/2012 Atoui
8,403,819 B2 3/2013 Zoeckler
8,403,820 B2 3/2013 Zoeckler
8,468,782 B2 6/2013 Michalsky et al.
8,474,163 B2 7/2013 Rubin
8,479,972 B2 * 7/2013 Craft ..... B65D 5/0005 229/101
8,500,330 B2 8/2013 Nomura et al.
8,579,780 B2 11/2013 Senbo
8,672,214 B2 3/2014 Manaige
8,727,204 B2 5/2014 Burke
8,826,959 B2 9/2014 Files et al.
8,870,519 B2 10/2014 Karst
8,961,380 B2 2/2015 Langen
9,050,770 B1 6/2015 Russell
9,073,659 B2 7/2015 Smith
9,108,761 B2 8/2015 Fitzwater et al.
9,113,648 B2 8/2015 Burke
9,156,579 B2 10/2015 Pinkstone
9,156,582 B2 10/2015 Walsh et al.
9,238,343 B2 1/2016 Selle et al.
9,346,234 B2 5/2016 Hajek et al.
9,346,582 B2 5/2016 Pinkstone
9,463,896 B2 10/2016 Fitzwater
9,522,499 B2 12/2016 Files et al.
9,663,320 B2 5/2017 Wittmann et al.
9,758,275 B2 9/2017 Fitwater et al.
9,771,176 B2 9/2017 Kastanek et al.
9,957,080 B2 5/2018 Kastanek
10,023,349 B2 * 7/2018 Fitzwater ..... B65D 5/106

(56) References Cited

U.S. PATENT DOCUMENTS

| | | | | |
|---|---|---|---|---|
| 10,173,805 | B2 * | 1/2019 | Waddington | B65D 5/0209 |
| 10,562,675 | B2 | 2/2020 | Walsh | |
| 10,640,271 | B2 | 5/2020 | Walsh | |
| 10,737,824 | B2 * | 8/2020 | Fitzwater | B65D 5/4266 |
| 2002/0041067 | A1 | 4/2002 | Muller | |
| 2002/0148882 | A1 | 10/2002 | Bowers | |
| 2003/0002755 | A1 | 1/2003 | Kim et al. | |
| 2003/0080120 | A1 | 5/2003 | Whitmore et al. | |
| 2003/0144121 | A1 | 7/2003 | Walsh | |
| 2003/0185948 | A1 | 10/2003 | Garwood | |
| 2003/0197051 | A1 | 10/2003 | Muise | |
| 2003/0206997 | A1 | 11/2003 | Winkelman et al. | |
| 2004/0004111 | A1 | 1/2004 | Cardinale | |
| 2004/0016216 | A1 | 1/2004 | Romagnoli | |
| 2004/0074947 | A1 | 4/2004 | Hillebrand | |
| 2004/0101605 | A1 | 5/2004 | Sigel | |
| 2004/0206049 | A1 | 10/2004 | Hiramoto et al. | |
| 2005/0014623 | A1 | 1/2005 | Van De Kruys | |
| 2005/0124478 | A1 | 6/2005 | Scholtes et al. | |
| 2005/0272583 | A1 | 12/2005 | Totani | |
| 2005/0284865 | A1 | 12/2005 | Fogle et al. | |
| 2006/0009339 | A1 | 1/2006 | Sleight et al. | |
| 2006/0027303 | A1 | 2/2006 | Hunter | |
| 2006/0037290 | A1 | 2/2006 | Smith | |
| 2006/0049190 | A1 | 3/2006 | Middleton | |
| 2006/0096978 | A1 | 5/2006 | Lafferty et al. | |
| 2006/0113300 | A1 | 6/2006 | Wnek et al. | |
| 2006/0191929 | A1 | 8/2006 | Berg, Jr. et al. | |
| 2007/0131742 | A1 | 6/2007 | Fitzwater | |
| 2007/0131743 | A1 | 6/2007 | Fitzwater | |
| 2007/0131744 | A1 | 6/2007 | Fitzwater | |
| 2007/0131745 | A1 | 6/2007 | Fitzwater | |
| 2007/0137222 | A1 | 6/2007 | Kastanek et al. | |
| 2007/0138247 | A1 | 6/2007 | Fitzwater | |
| 2007/0151888 | A1 | 7/2007 | Bossel et al. | |
| 2007/0267466 | A1 | 11/2007 | Brand et al. | |
| 2008/0067225 | A1 | 3/2008 | Moore | |
| 2008/0227612 | A1 | 9/2008 | Harston | |
| 2008/0308614 | A1 | 12/2008 | Fitzwater | |
| 2009/0005228 | A1 | 1/2009 | Goto | |
| 2009/0039077 | A1 | 2/2009 | Fitzwater | |
| 2009/0139187 | A1 | 6/2009 | Wood | |
| 2009/0193757 | A1 | 8/2009 | Roesler | |
| 2009/0197750 | A1 | 8/2009 | Beckmann | |
| 2009/0214142 | A1 | 8/2009 | Bossel et al. | |
| 2009/0252440 | A1 | 10/2009 | Biese | |
| 2010/0022375 | A1 | 1/2010 | Colla | |
| 2010/0046861 | A1 | 2/2010 | Wilcoxen | |
| 2010/0066007 | A1 | 3/2010 | Muller | |
| 2010/0263332 | A1 | 10/2010 | Files et al. | |
| 2010/0284634 | A1 | 11/2010 | Hadley | |
| 2011/0017812 | A1 | 1/2011 | Belko et al. | |
| 2011/0019942 | A1 | 1/2011 | Piraneo | |
| 2011/0052106 | A1 | 3/2011 | Holmes et al. | |
| 2011/0053746 | A1 | 3/2011 | Desertot et al. | |
| 2011/0255809 | A1 | 10/2011 | Tucker et al. | |
| 2011/0297680 | A1 | 12/2011 | Howell et al. | |
| 2012/0224794 | A1 | 9/2012 | Veder | |
| 2012/0231941 | A1 | 9/2012 | Senbo | |
| 2012/0267425 | A1 | 10/2012 | Whiteside | |
| 2012/0297736 | A1 | 11/2012 | Ausnit | |
| 2013/0068653 | A1 | 3/2013 | Lipinski | |
| 2013/0202229 | A1 | 8/2013 | Broering | |
| 2014/0016882 | A1 | 1/2014 | Fitzwater | |
| 2014/0045666 | A1 | 2/2014 | Endou et al. | |
| 2014/0113787 | A1 | 4/2014 | Aganovic et al. | |
| 2014/0128235 | A1 | 5/2014 | Walsh et al. | |
| 2014/0270592 | A1 | 9/2014 | Walsh | |
| 2015/0048152 | A1 | 2/2015 | Vistrom | |
| 2015/0072848 | A1 | 3/2015 | Graham et al. | |
| 2015/0083789 | A1 | 3/2015 | Fitzwater et al. | |
| 2015/0367974 | A1 | 12/2015 | Sytema | |
| 2016/0107814 | A1 | 4/2016 | Fitzwater. | |
| 2016/0159516 | A1 | 6/2016 | Ball | |
| 2016/0185065 | A1 | 6/2016 | Sytema | |
| 2016/0318274 | A1 | 11/2016 | Walsh | |
| 2016/0318275 | A1 | 11/2016 | Walsh | |
| 2016/0368205 | A1 | 12/2016 | Wieduwilt et al. | |
| 2017/0015079 | A1 | 1/2017 | Walsh | |
| 2018/0086018 | A1 | 3/2018 | Fukuda | |
| 2018/0339480 | A1 | 11/2018 | Yanagisawa | |
| 2019/0143625 | A1 | 5/2019 | Lau | |

FOREIGN PATENT DOCUMENTS

| | | | |
|---|---|---|---|
| CN | 101102887 | A | 1/2008 |
| CN | 103434294 | A | 12/2013 |
| DE | 1 060 313 | | 6/1959 |
| DE | 11 47 379 | B | 4/1963 |
| DE | 18 10 965 | A1 | 10/1970 |
| DE | 203 00 817 | | 4/2003 |
| EP | 0 729 828 | A2 | 9/1996 |
| EP | 1 072 526 | | 1/2001 |
| EP | 1 424 290 | A2 | 6/2004 |
| EP | 1 452 458 | | 9/2004 |
| EP | 1 457 425 | | 9/2004 |
| EP | 1 353 843 | B1 | 4/2005 |
| EP | 1 798 159 | A1 | 6/2007 |
| EP | 1 964 785 | | 9/2008 |
| EP | 2 487 027 | | 8/2012 |
| EP | 2 492 203 | | 8/2012 |
| EP | 2 492 204 | | 8/2012 |
| EP | 2 748 078 | B1 | 10/2016 |
| EP | 2 505 347 | B1 | 12/2016 |
| FR | 1 048 714 | A | 12/1953 |
| FR | 2 516 481 | | 5/1983 |
| FR | 2 665 882 | | 2/1992 |
| FR | 2 687 384 | | 8/1993 |
| GB | 632554 | | 11/1949 |
| GB | 2 351 035 | A | 12/2000 |
| GB | 2 365 000 | | 2/2002 |
| JP | S61-232175 | | 10/1986 |
| JP | 62-16319 | | 1/1987 |
| JP | S63-502418 | | 9/1988 |
| JP | 5-28626 | | 4/1993 |
| JP | 5-147664 | | 6/1993 |
| JP | 2004 224402 | | 8/2004 |
| JP | 2005-320022 | A | 11/2005 |
| JP | 2006-240671 | A | 9/2006 |
| JP | 2008-105707 | A | 5/2008 |
| JP | 2011-168330 | | 9/2011 |
| JP | 2011-168331 | | 9/2011 |
| JP | 2011-173640 | | 9/2011 |
| JP | 2011-189978 | A | 9/2011 |
| JP | 2010-222050 | | 10/2011 |
| JP | 2011-251774 | A | 12/2011 |
| JP | 2012-51579 | | 3/2012 |
| JP | 2012-152901 | | 8/2012 |
| JP | 2012-187899 | | 10/2012 |
| JP | 2012-533487 | | 12/2012 |
| JP | 2018-039167 | | 3/2018 |
| KR | 20-0487643 | Y1 | 10/2018 |
| NL | 87 840 | C | 11/1957 |
| WO | WO 87/03249 | | 6/1987 |
| WO | WO 2006/052326 | | 5/2006 |
| WO | WO 2007/067705 | | 6/2007 |
| WO | WO 2007/084525 | A2 | 7/2007 |
| WO | WO 2008/086277 | | 7/2008 |
| WO | WO 2009/023286 | | 2/2009 |
| WO | WO 2011/011283 | A2 | 1/2011 |
| WO | WO 2011/031545 | A2 | 3/2011 |
| WO | WO 2011/040994 | A1 | 4/2011 |
| WO | WO 2013/003149 | A | 1/2013 |
| WO | WO 2013/117983 | A2 | 8/2013 |
| WO | WO 2014/070232 | A1 | 5/2014 |
| WO | WO 2015/028825 | A1 | 3/2015 |
| WO | WO 2016/176540 | A1 | 11/2016 |

* cited by examiner

REINFORCED PACKAGE

CROSS-REFERENCE TO RELATED APPLICATIONS

This application claims the benefit of U.S. Provisional Patent Application No. 62/797,560, filed on Jan. 28, 2019.

INCORPORATION BY REFERENCE

The disclosures of U.S. Provisional Patent Application No. 62/797,560, filed Jan. 28, 2019, U.S. patent application Ser. No. 15/630,061, filed Jul. 22, 2017, U.S. Provisional Patent Application No. 62/354,270, filed Jun. 24, 2016, U.S. patent application Ser. No. 15/217,026, filed Jul. 22, 2016, U.S. Provisional Patent Application No. 62/282,049, filed Jul. 23, 2015, U.S. patent application Ser. No. 14/496,252, filed Sep. 25, 2014, U.S. Provisional Patent Application No. 61/960,712, filed on Sep. 25, 2013, U.S. patent application Ser. No. 15/209,013, filed Jul. 13, 2016, and U.S. Provisional Patent Application No. 62/231,723, filed on Jul. 14, 2015, are hereby incorporated by reference for all purposes as if presented herein in their entirety.

BACKGROUND OF THE DISCLOSURE

The present disclosure generally relates to reinforced packages for holding products and to methods of forming the packages. More specifically, the present disclosure is directed to a package including a bag or liner attached to a carton.

Bags or liners, such as paper or plastic bags, traditionally have been used for the packaging and transport of products from bulk materials such as rice or sand to larger items. Bags or liners generally are inexpensive and easy to manufacture and can be formed in different configurations and sizes, and can be used for storage and transport of a wide variety of products. In particular, in the food service industry, bags or liners are frequently used for packaging of prepared food items, such as sandwiches, French fries, cereal, etc. Currently, there is a growing demand for bags or liners or similar packages for use in packaging various products, including sandwiches, French fries, cereal, and other prepared food items, for presentation to consumers. However, it is equally important that the costs of such packages necessarily must be minimized as much as possible. While various packages designs including reinforcing or supporting materials have been developed, often, the manufacture of such specialty bags or liners having reinforcing layers or materials supplied thereto has required multiple stages or operations, which can significantly increase the cost of manufacture of such packages.

SUMMARY OF THE DISCLOSURE

In general, one aspect of the disclosure is directed to a reinforced package comprising a carton comprising a plurality of panels that extends at least partially around an interior of the carton. The plurality of panels can comprise a front panel and a back panel disposed opposite to the front panel. The carton can comprise a bottom wall foldably connected to the front panel along a first curved fold line and to the back panel along a second curved fold line. The reinforced package further can include a bag at least partially attached to the carton. The bag can be at least partially defining an interior space for holding a product. The carton can be positionable in a non-erect position wherein the interior space of the bag is at least partially collapsed and in an erect position wherein the interior space of the bag is increased. The carton can be configured to support the bag in the erect position and at least the bottom wall and the first curved fold line can be configured to retain the carton in the erect position.

In another aspect, the disclosure is generally directed to, in combination, a carton blank and a bag for forming a reinforced package for holding a product. The carton blank can be for forming a carton and can comprise a plurality of panels comprising a front panel and a back panel, the carton blank comprising a first bottom end flap foldably connected to the front panel along a first curved fold line and a second bottom end flap foldably connected to the back panel along a second curved fold line. The first bottom end flap and the second bottom end flap can at least partially form a bottom wall when the carton is formed from the carton blank. A bag can be at least partially attached to the carton blank, and the bag can at least partially define an interior space for holding a product. The carton formed from the carton blank can be positionable in a non-erect position wherein the interior space of the bag is at least partially collapsed and in an erect position wherein the interior space of the bag is increased when the reinforced package is formed from the carton blank and the bag. The carton formed from the carton blank can be configured to support the bag in the erect position when the reinforced package is formed from the carton blank and the bag. At least the bottom wall and the first curved fold line can be configured to retain the carton in the erect position when the reinforced package is formed from the carton blank and the bag.

In another aspect, the disclosure is generally directed to a method of forming a reinforced package for holding a product. The method can comprise obtaining a carton blank comprising a plurality of panels comprising a front panel and a back panel, the carton blank comprising a first bottom end flap foldably connected to the front panel along a first curved fold line and a second bottom end flap foldably connected to the back panel along a second curved fold line. The method further can comprise forming a bag at least partially attached to the carton blank, the bag at least partially defining an interior space for holding a product, and forming an interior of a carton at least partially defined by the plurality of panels with the back panel disposed opposite to the front panel. The forming the interior of the carton can comprise forming a bottom wall comprising the first bottom end flap and the second bottom end flap. The carton can be positionable in a non-erect position wherein the interior space of the bag is at least partially collapsed and in an erect position wherein the interior space of the bag is increased, and the carton can be configured to support the bag in the erect position. At least the bottom wall and the first curved fold line can be configured to retain the carton in the erect position.

Other aspects, features, and details of the present disclosure can be more completely understood by reference to the following detailed description of exemplary embodiment taken in conjunction with the drawings and from the appended claims.

BRIEF DESCRIPTION OF THE DRAWINGS

Those skilled in the art will appreciate the above stated advantages and other advantages and benefits of various additional embodiments reading the following detailed description of the embodiments with reference to the below-listed drawing figures. It is within the scope of the present disclosure that the above-discussed aspects be provided both individually and in various combinations.

According to common practice, the various features of the drawings discussed below are not necessarily drawn to scale. Dimensions of various features and elements in the drawings may be expanded or reduced to more clearly illustrate the embodiments of the disclosure.

Corresponding parts are designated by corresponding reference numbers throughout the drawings.

DETAILED DESCRIPTION OF THE EXEMPLARY EMBODIMENTS

The present disclosure generally relates to a reinforced package for holding products such as food products or other articles. Packages according to the present disclosure can accommodate articles of any shape. The packages can comprise a bag, liner, or wrap material comprising a relatively flexible material attached to a reinforcing construct comprising a relatively rigid material (e.g., paperboard). The bags or liners can generally be made from a paper, plastic or other stock material and can be attached to the reinforcing construct. In one embodiment, the liners comprise polyethylene material or any other suitable heat-sealable material. The reinforcing construct can be of varying widths and can extend about or over the closed ends of the bags, in some embodiments enclosing such closed ends, and will provide support for the bags upon loading with a product or article or series of articles therein. In some embodiments, the reinforcing construct can be folded with their bags into a configuration supporting the bags in a freestanding, upright and opened condition for ease of loading and ease of use.

Figure 1:
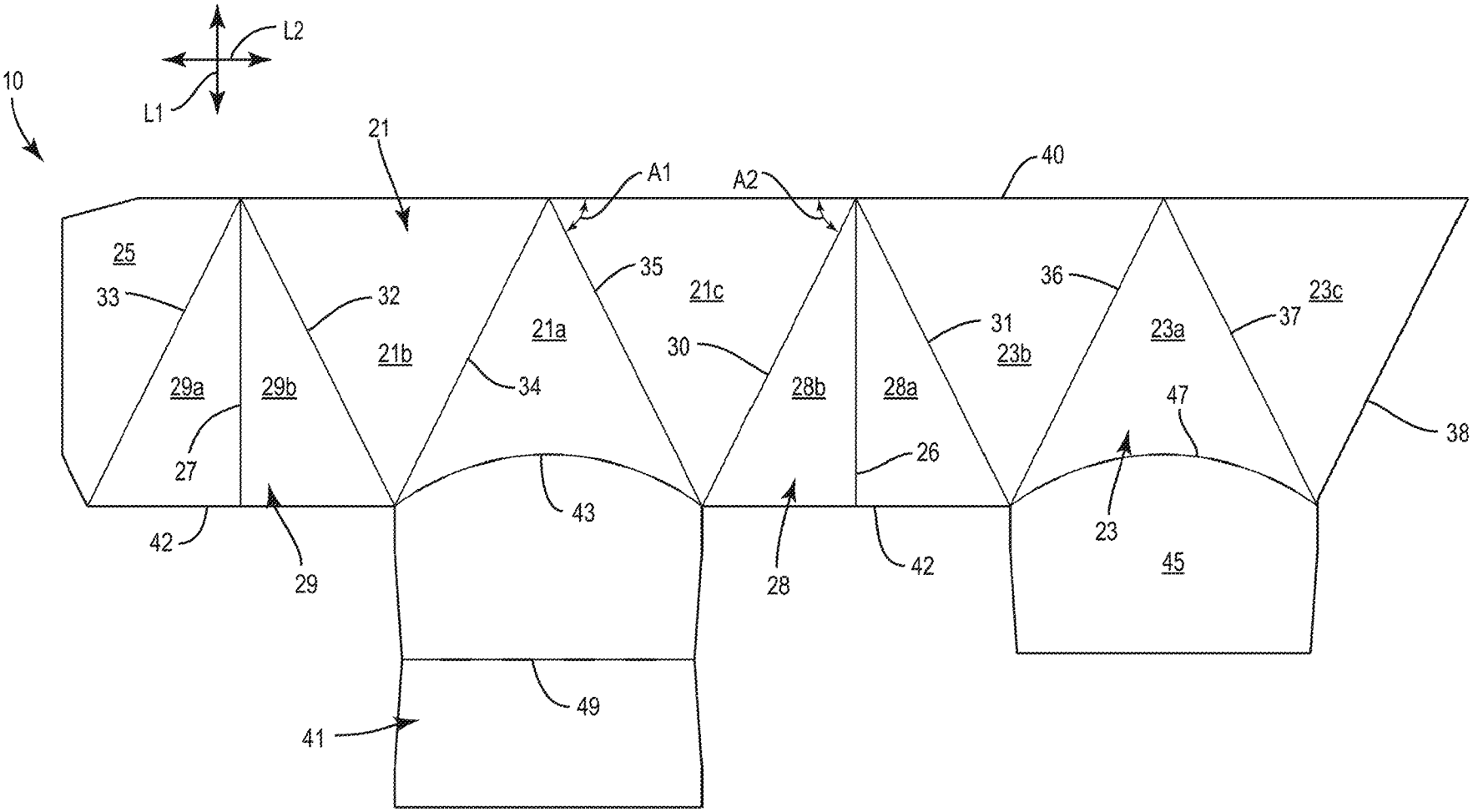
FIG. 1 is an exterior plan view of a blank used to form a carton of a package according to an exemplary embodiment of the disclosure.

FIG. 1 illustrates a blank 10 for forming a reinforced package generally indicated at 1 (FIGS. 5-10), that includes a bag 3 attached to a carton 5 according to one embodiment of the disclosure. The bag 3 has an open top end 7 (FIG. 6), a closed or sealed bottom end 9 (FIGS. 3, 4, and 10), and an interior space 17 (FIGS. 7 and 10) for holding a product. In one embodiment, the bag 3 has sealed sides 19 (FIGS. 3, 4, and 6-8) extending the length of the bag between the top 7 and bottom 9. As shown in FIGS. 5 and 8-10, the reinforcing carton 5 has a bottom 20 (e.g., a bottom wall 20) that supports the sealed bottom 9 of the bag 3. The carton 5 has other features as further described herein to reinforce the package 1 by increasing the rigidity of the package 1 and to lock the package in the formed state of FIGS. 6-10. The carton 5 can facilitate forming the package 1 and keeping the package 1 open to allow access to the contents in the interior space 17 of the bag 3.

As shown in FIG. 1, the blank 10 has a lateral axis L1 and a longitudinal axis L2. In the illustrated embodiment, the blank 10 has a front panel 21 foldably connected to a first side panel 28 at a first fold line 30. The first side panel 28 includes two individual panel portions 28*a*, 28*b* foldably connected to one another at lateral fold line 26. A first back panel 23 is foldably connected to the first side panel 28 at a second fold line 31. A second side panel 29 is foldably connected to the front panel 21 at a third fold line 32. The second side panel 29 includes two individual panel portions 29*a*, 29*b* foldably connected to one another at lateral fold line 27. An attachment flap or second back panel 25 is foldably connected to the second side panel 29 at a fourth fold line 33.

As shown in FIG. 1, the front panel 21 can include a center portion 21*a* and two corner portions 21*b*, 21*c*, and the corner portions 21*b*, 21*c* can be foldably connected to the center portion 21*a* along respective fold lines 34, 35. Similarly, the back panel 23 can include a center portion 23*a* and two corner portions 23*b*, 23*c*, which can be foldably connected to the center portion 23*a* along respective fold lines 36, 37. In the illustrated embodiment, the fold lines 30, 31, 32, 33, 34, 35, 36, 37 are oblique so that each of the side panels 28, 29 and each of the corner portions 21*b*, 21*c*, 23*b* are triangular. In one embodiment, the corner portion 23*c* can comprise an oblique edge 38 so that it is triangular as well, and the oblique edge can extend along and/or adjacent the oblique fold line 33 when the carton 5 is formed and the attachment panel 25 is adhered to the corner portion 23*c*. In the illustrated embodiment, the fold lines 31, 32, 35, and 37 are generally parallel and are positioned at an angle A1 relative to the longitudinal top edge 40 of the blank 10. The fold lines 30, 33, 34, 36 are generally parallel and are positioned at an angle A2 relative to the top edge 40. In the illustrated embodiment, the angles A1, A2 are approximately 60 degrees, but the angles could be more or less than 60 degrees without departing from the disclosure.

As shown in FIG. 1, the blank 10 includes a first bottom end flap or bottom panel 41 foldably connected to the center portion 21*a* of the front panel 21 at a curved fold line 43 and a second bottom end flap 45 foldably connected to the center portion 23*a* of the back panel 23 at a curved fold line 47. As shown in FIG. 1, the curved fold lines 43, 47 are curved away from the bottom end flaps 41, 45 and toward the front and back panels 21, 23 (e.g., the curved fold lines 43, 47 are concave with respect to the respective bottom end flaps 41, 45 and convex with respect to the front and back panels 21, 23). In one embodiment, the center portions 21*a*, 23*a* can be partially triangular with two sides formed by the respective oblique fold lines 34, 35 and 36, 37 and a curved side formed by the respective curved fold lines 43, 47. In the illustrated embodiment, the first bottom end flap 41 includes a longitudinal fold line 49 (e.g., bottom fold line or a central fold line) extending across the width of the bottom end flap 41. Any of the front panel 21, the back panels 23, 25, the side panels 28, 29, the bottom end flaps 41, 45 could be omitted or could be otherwise arranged, shaped, positioned, and/or configured without departing from the disclosure. For example, the bottom fold line 49 could be in either or both of the bottom end flaps 41, 45 (e.g., the second bottom end flap 45 could be similar or identical to the first bottom end flap 41 and/or the first bottom end flap 41 could be similar or identical to the second bottom end flap 45).

As shown in FIG. 1, the side panels 28, 29 and the portions of the front and back panels 21, 23 can be triangles (e.g., generally or at least partially triangularly shaped) having alternating orientations so that the side panels 28, 29 and the center portions 21*a*, 23*a* have a first orientation and the corner portions 21*b*, 21*c*, 23*b*, 23*c* have an opposing second orientation. In the illustrated embodiment, the triangles of the side panels 28, 29 can be divided into two triangles (e.g., right triangles) by the respective lateral fold lines 26, 27. As shown in FIG. 1, fold lines 27, 32, 33 can at least partially converge (e.g., can intersect to form a vertex and/or can approach one another to nearly intersect) at the top edge 40 of the blank 10. Similarly, the fold lines 34, 35 can at least partially converge at the top edge 40 of the blank 10, the fold lines 26, 30, 31 can at least partially converge at the top edge 40 of the blank 10, the fold lines 36, 37 can at least partially converge at the top edge 40 of the blank 10, the fold lines 32, 34, 43 can at least partially converge at a bottom edge 42 of the blank 10, fold lines 30, 35, 43 can at least partially converge at the bottom edge 42 of the blank 10, the fold lines 31, 36, 47 can at least partially converge at the bottom edge 42 of the blank 10, and the fold lines 37, 47, and the edge 38 can at least partially converge at the bottom edge 42 of the blank 10. In one embodiment, the lateral fold lines 26, 27 and the oblique fold lines 30, 31, 32, 33, 34, 35, 36, 37 can be creases and the curved fold lines 43, 47 can be cut-crease fold lines. Alternatively, the fold lines 26, 27, 30, 31, 32, 33, 34, 35, 36, 37, 43, 47 could be other suitable features (e.g., could be creases, cut-creases, perforations, etc., and/or could be alternatively shaped) without departing from the disclosure. In addition, the shape and/or orientation of the side panels 28, 29 and/or the portions of the front and back panels 21, 23 could have other orientations and/or shapes without departing from the disclosure.

In the illustrated embodiment, the curved fold lines 43, 47 can comprise strengthening or retention features of the blank that strengthen and reinforce the package 1 formed from the blank by increasing the rigidity of the bottom and/or the sides of the carton 5. For example, in one embodiment, the strengthening features can help retain the package in the erected or expanded configuration shown in FIGS. 6-10 as described in more detail below. In one embodiment, the fold lines 26, 27, 30, 31, 32, 33, 34, 35, 36, 37, 49 and the shapes of the portions of the side panels 28, 29 and the front and back panels 21, 23 also can contribute to the strengthening features. Any of the fold lines 26, 27, 30, 31, 32, 33, 34, 35, 36, 37, 43, 47, 49 and the side panels 28, 29 could be omitted and/or could be otherwise arranged, shaped, positioned, and/or configured without departing from the disclosure.

Figure 3:
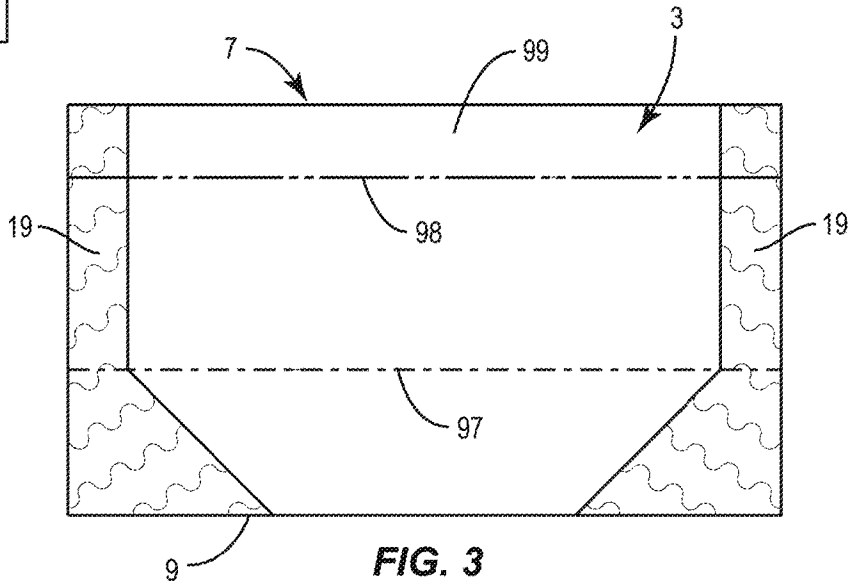
FIG. 3 is a view of a bag formed from the web portion of FIG. 2.
Figure 2:
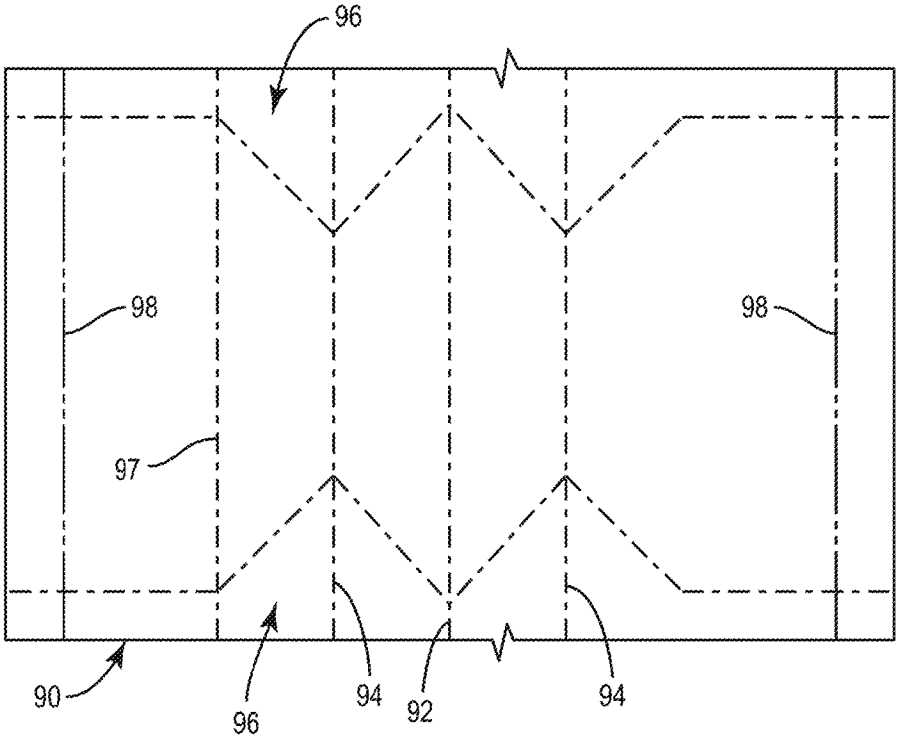
FIG. 2 is a plan view of a portion of a web for forming a bag of the package according to the exemplary embodiment of the disclosure.
Figure 4:
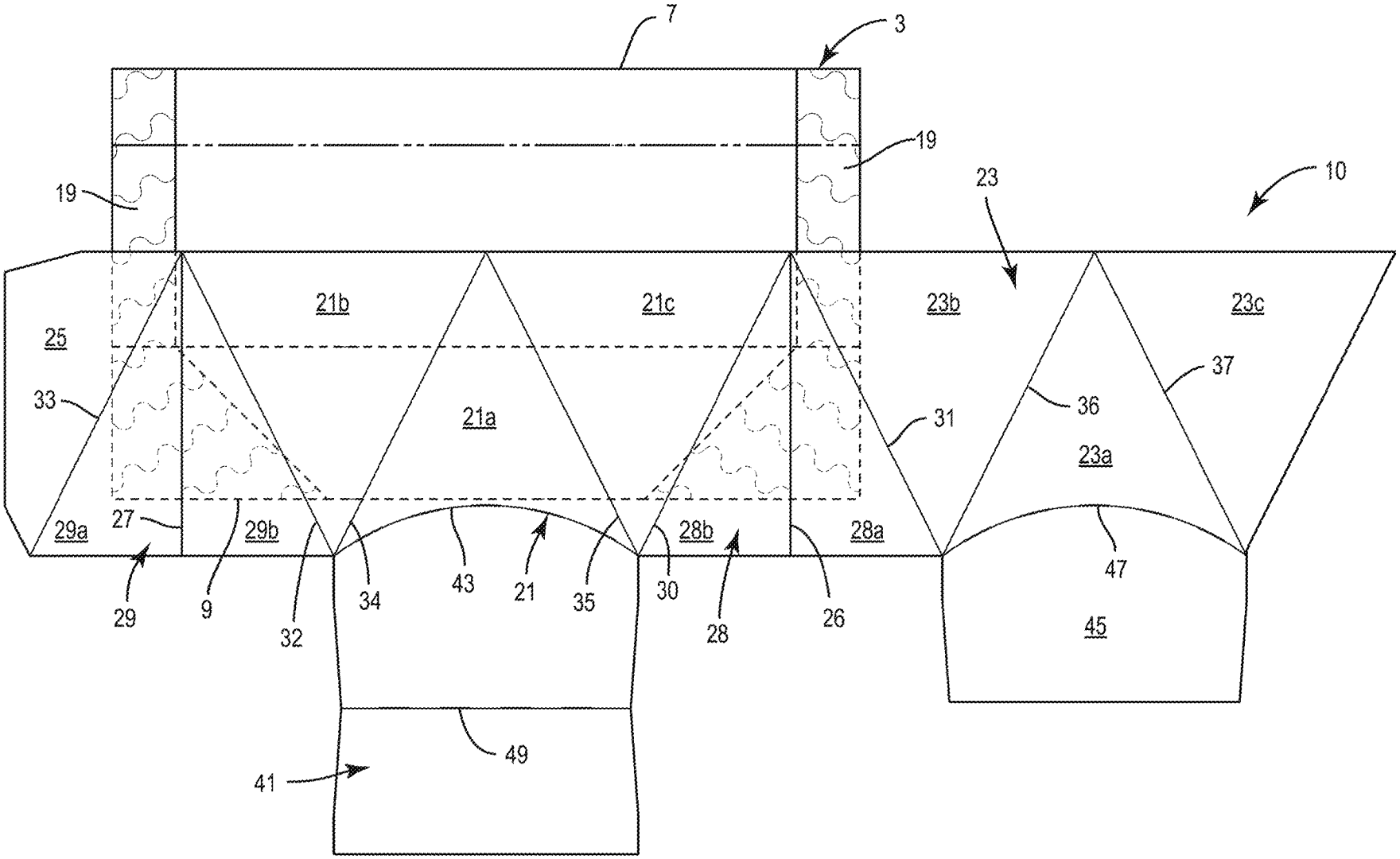
FIG. 4 is an exterior plan view showing the bag of FIG. 3 attached to the interior of the carton blank of FIG. 1 according to the exemplary embodiment of the disclosure, wherein the bag is shown partially in phantom.

In one embodiment, the bag 3 (FIGS. 3-8 and 10) can be formed from similar methods and have similar features as the bag shown in U.S. Provisional Patent Application No. 62/231,723 filed Jul. 14, 2015, and U.S. patent application Ser. No. 15/209,013 filed Jul. 13, 2016, which are incorporated by reference herein. The bag 3 can be formed by a portion of suitable material 90 shown in FIG. 2 that has a central fold 92 and two outer folds 94 that form the gusseted bottom 9 of the bag 3. In addition, the portion 90 of bag material can have two edge margins 96 extending along the length of the portion 90 as indicated by the dashed lines in FIG. 2. When the gusseted bottom 9 of the bag 3 is formed, the central fold 92 and the two outer folds 94 form four layers of overlapped material at the bottom of the bag such that the bottom of the bag is expandable to accommodate various sizes of product to be held in the bag when the carton 5 is formed to the erected position of the package 1. The portion 90 of bag material is folded at the central fold 92 and outer folds 94 and the overlapping portions of the edge margins 96 can be sealed together (e.g., heat sealed, welded, adhered, or otherwise secured together) to form the sealed sides 19 that extend into the bottom 9 of the bag so that the side portions of the overlapped layers of material in the bag 3 are sealed. In the flat configuration of the bag 3 (FIG. 3), the outer folds 94 form the lowermost edge of the bag. In one embodiment, the material for forming the bags 3 can include preprinted paper, polyethylene or other material including flexible and heat-sealable materials. In the illustrated embodiment, the bag 3 can include a fill line 97 and tear lines 98 (e.g., laser cut perforations), wherein the fill line 97 indicates an exemplary location of guide line for adding material (e.g., a liquid) to the contents of the bag 3 and the tear lines 98 form an opening feature 99 in the bag 3 (FIG. 3). In one embodiment, the opening feature 99 can be sealed at the top of the bag 3 and can be opened by tearing along the tear lines 98. The bag 3 could be otherwise shaped, arranged, and/or configured without departing from the disclosure. Further, the bag 3 could be otherwise formed without departing from the disclosure.

In one embodiment, the reinforced package 1 can be formed by similar systems and methods as shown in one or more of the incorporated by reference patent applications, wherein the packaging system attaches a web of material for forming the bags 3 of the packages 1 to the blanks 10, and the blanks and web move through a respective packaging system and are formed into the individual packages by various portions and components of the system. The blanks 10 are formed into the reinforced cartons 5 and the web of material is formed into the bags 3, with respective portions 90 of the web of material being overlapped to form the bags. The reinforced packages 1 include the reinforced carton 5 having a bag 3 attached. In one embodiment, the bags 3 can be partially or fully formed prior to being attached to the carton blanks 10 and/or the bags 3 and/or the cartons 5 could be formed by hand.

Figure 5:
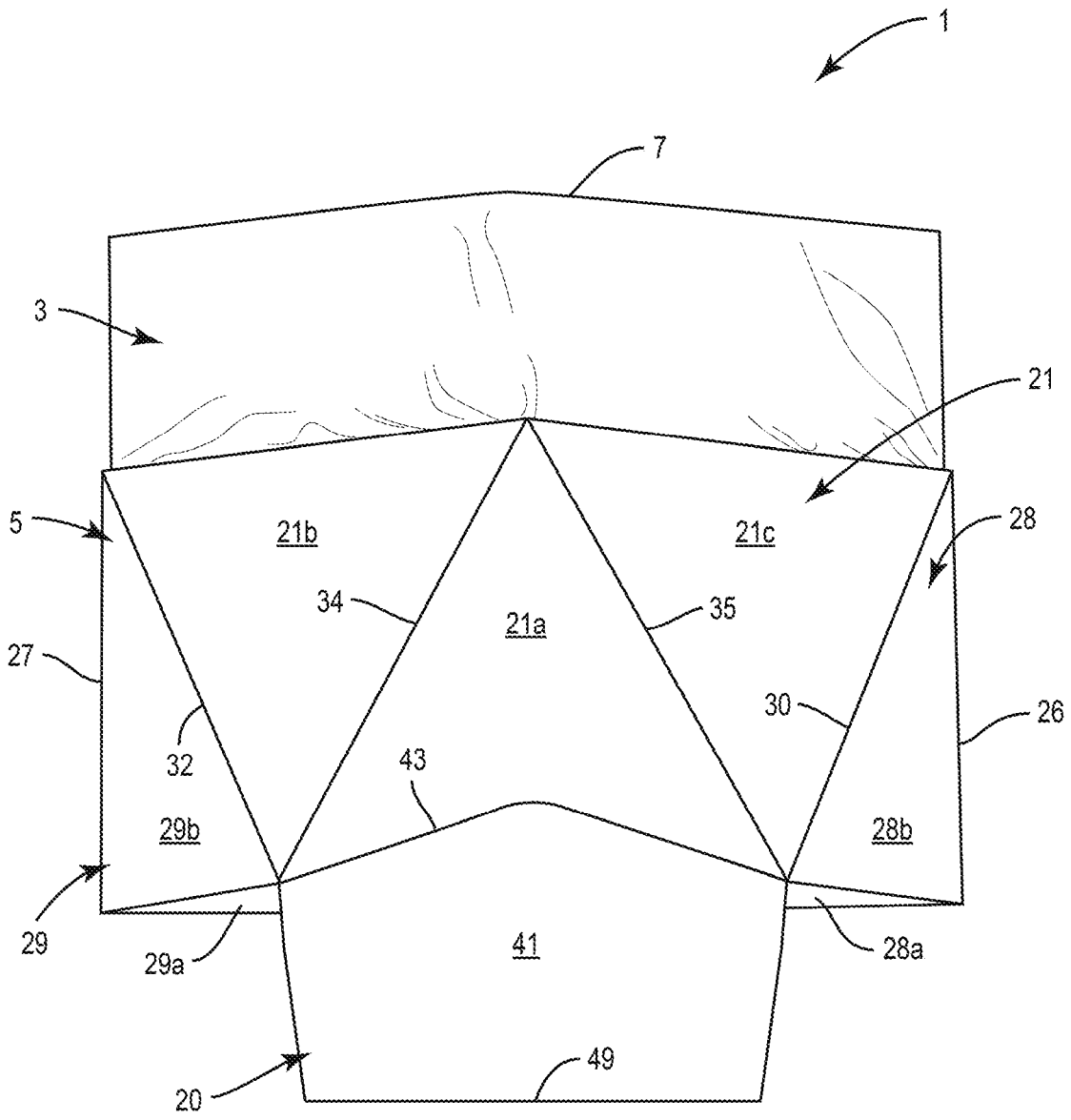
FIG. 5 is an elevation view of the package formed from the carton blank and bag of FIG. 4 according to the exemplary embodiment of the disclosure, wherein the package is in a flattened configuration.

In one embodiment, the separated individual blanks 10 and attached bags 3 are conveyed in the system to a folder/gluer carton forming assembly that includes a series of folders that position the various flaps and panels of the blank 10 to form the flat cartons 5 that can be packaged and shipped for filling with product. In the illustrated embodiment, the bag 3 can be attached to the front panel 21 of the blank 10 as shown in FIG. 3. In one embodiment, the bag 3 can be glued to each of the center portion 21*a* and the corner portions 21*b*, 21*c* of the front panel 21. Alternatively, the bag 3 could be glued to any portion of the front panel 21 or the bag 3 could be glued to at least a portion of the back panel 23. The blank 10 can be folded along the lateral fold lines 26, 27 so that the back panel 23 and the attachment flap 25 at least partially overlap the bag 3 and the front panel 21. In addition, the side portions 28*a*, 29*a* can overlap the respective side portions 28*b*, 29*b* in the respective side panels 28, 29. In one embodiment, the bag 3 can be glued to the back panel 23 (e.g., to any or all of the center portion 23*a* and the corner portions 23*b*, 23*c* of the back panel 23) and/or the attachment flap 25. Accordingly, the bag 3 can be attached to front panel 21, the back panel 23, and the attachment flap 25 of the carton 5. In the illustrated embodiment, the attachment flap 25 can be overlapped with the corner portion 23*c* of the back panel 23 and adhesively attached thereto. Also, as shown in FIG. 5, the first bottom end flap 41 can be folded along the longitudinal fold line 49 to overlap the second bottom end flap 45 and the bottom end flaps 41, 45 can be adhesively attached together to form the closed bottom wall 20 of the carton. As shown in FIGS. 5 and 8-10, the bottom wall 20 is foldably connected to the center portion 21*a* of the front panel 21 and the center portion 23*a* of the back panel 23 along the respective curved fold lines 43, 47. In one embodiment, the bag 3 can be free from attachment to the side panels 28, 29 and/or the bottom wall 20. The package 1 could be otherwise formed without departing from the disclosure.

Figure 6:
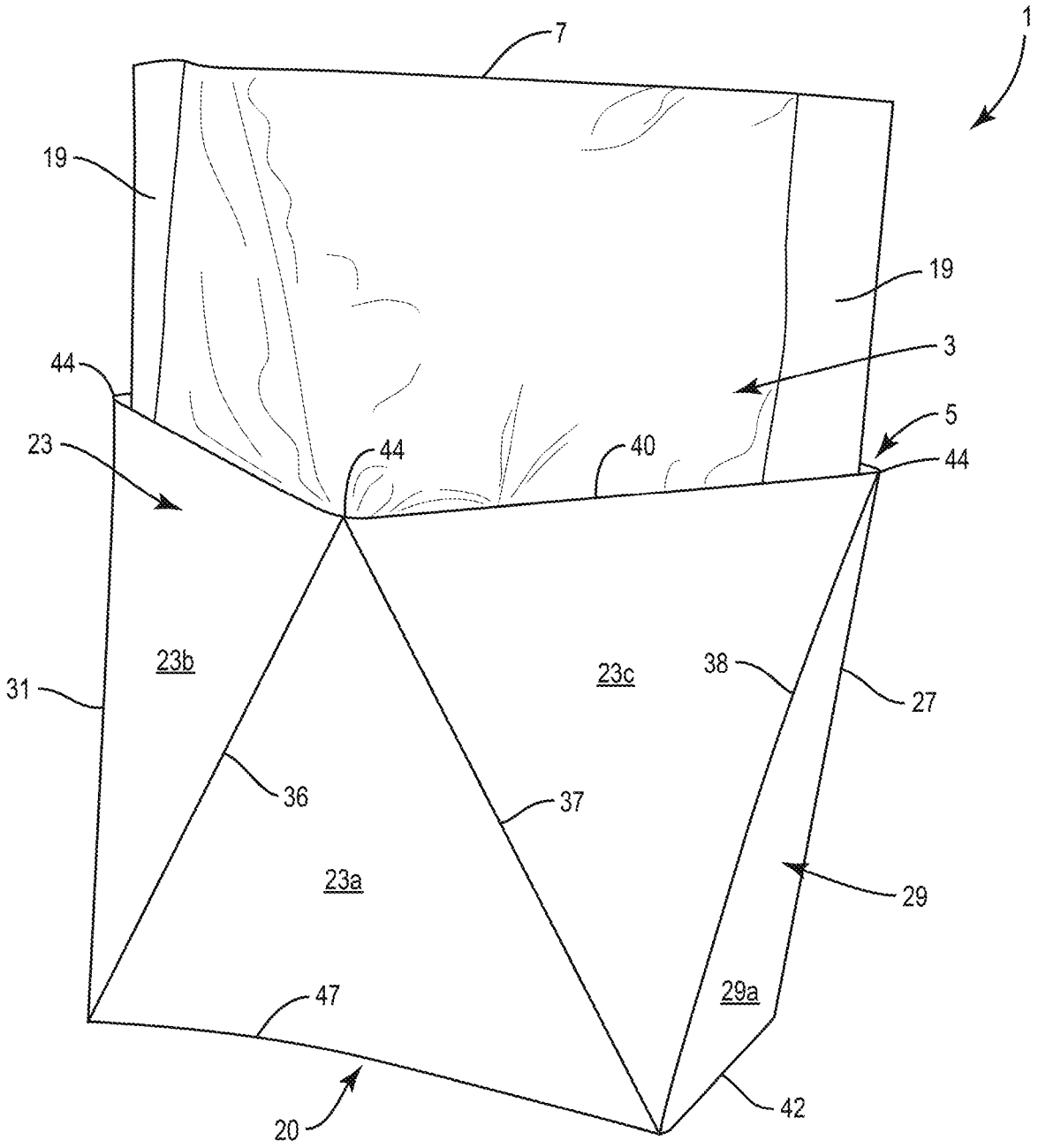
FIG. 6 is a perspective view of the package of FIG. 5 in an erected configuration according to the exemplary embodiment of the disclosure.
Figure 7:
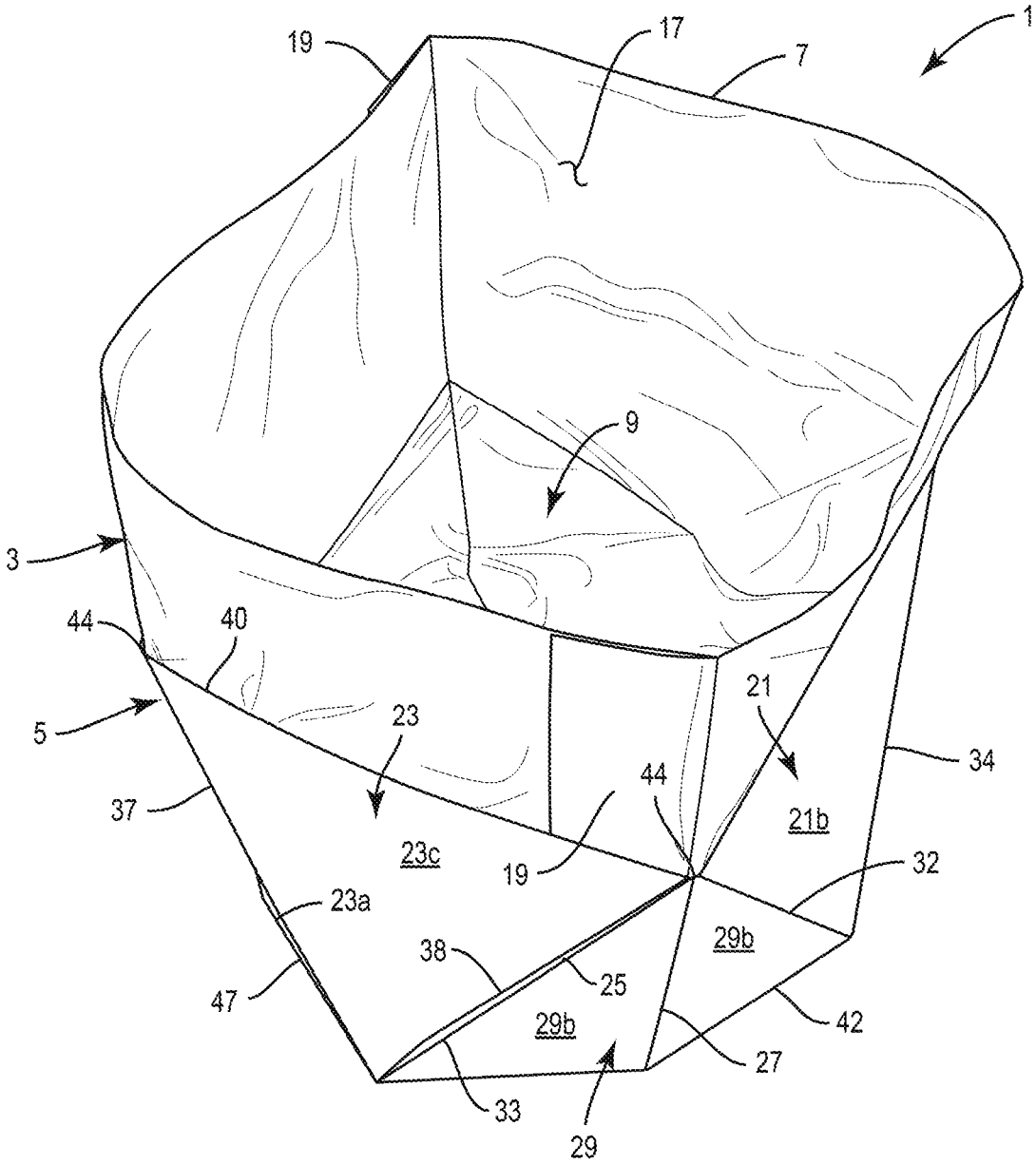
FIG. 7 is a top perspective view of the package of FIG. 6.

As shown in FIG. 5, the package 1 is in a non-erect, flattened, folded, or collapsed configuration or position. In the illustrated embodiment, the package 1 can be positioned to the erected configuration shown in FIGS. 6-10 by grasping the side panels 28, 29 and pushing the sides inwardly at fold lines 26, 27, causing the front panel 21 and back panel 23 to separate or move away from each other to give the package its three dimensional shape and form the interior space 17 of the bag 3 for holding a product. In the illustrated embodiment, the carton 5 can fold along the fold lines 26, 27, 30, 31, 32, 33, 34, 35, 36, 37 so that the side panels 28, 29 straighten (e.g., the portions 28*a*, 29*a* are coplanar or nearly coplanar with the respective portions 28*b*, 29*b*), the corner portions 21*b*, 21*c* extend obliquely from the central portion 21*a* to the respective side panels 29, 28, and the corner portions 23*b*, 23*c* extend obliquely from the central portion 23*a* to the respective side panels 28, 29. As shown in FIGS. 6 and 7, the corner portions 21*b*, 21*c*, 23*b*, 23*c* can extend downwardly and outwardly from the top edge 40 of the carton 5 to the corners of the bottom edge 42 of the carton while the side panels 28, 29 and the central portions 21*a*, 23*a* can extend upwardly and outwardly from the bottom edge 42 of the carton 5 to respective corners 44 formed at the top edge 40 of the carton 5. This configuration of the carton can give the carton a shape that is visually unique and that is easy to grasp and hold in one embodiment.

Figure 8:
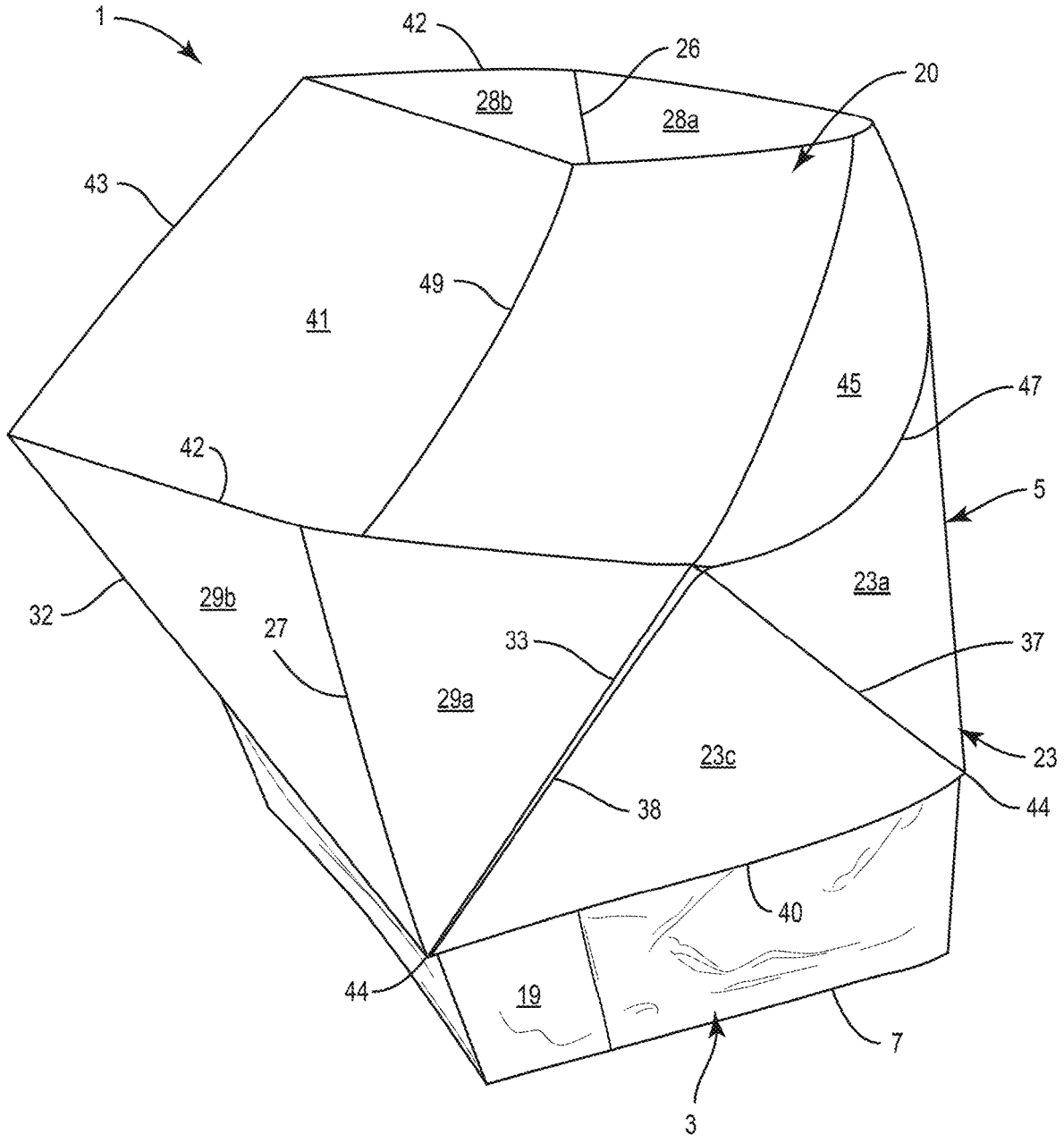
FIG. 8 is a bottom perspective view of the package of FIGS. 6 and 7.
Figure 9:
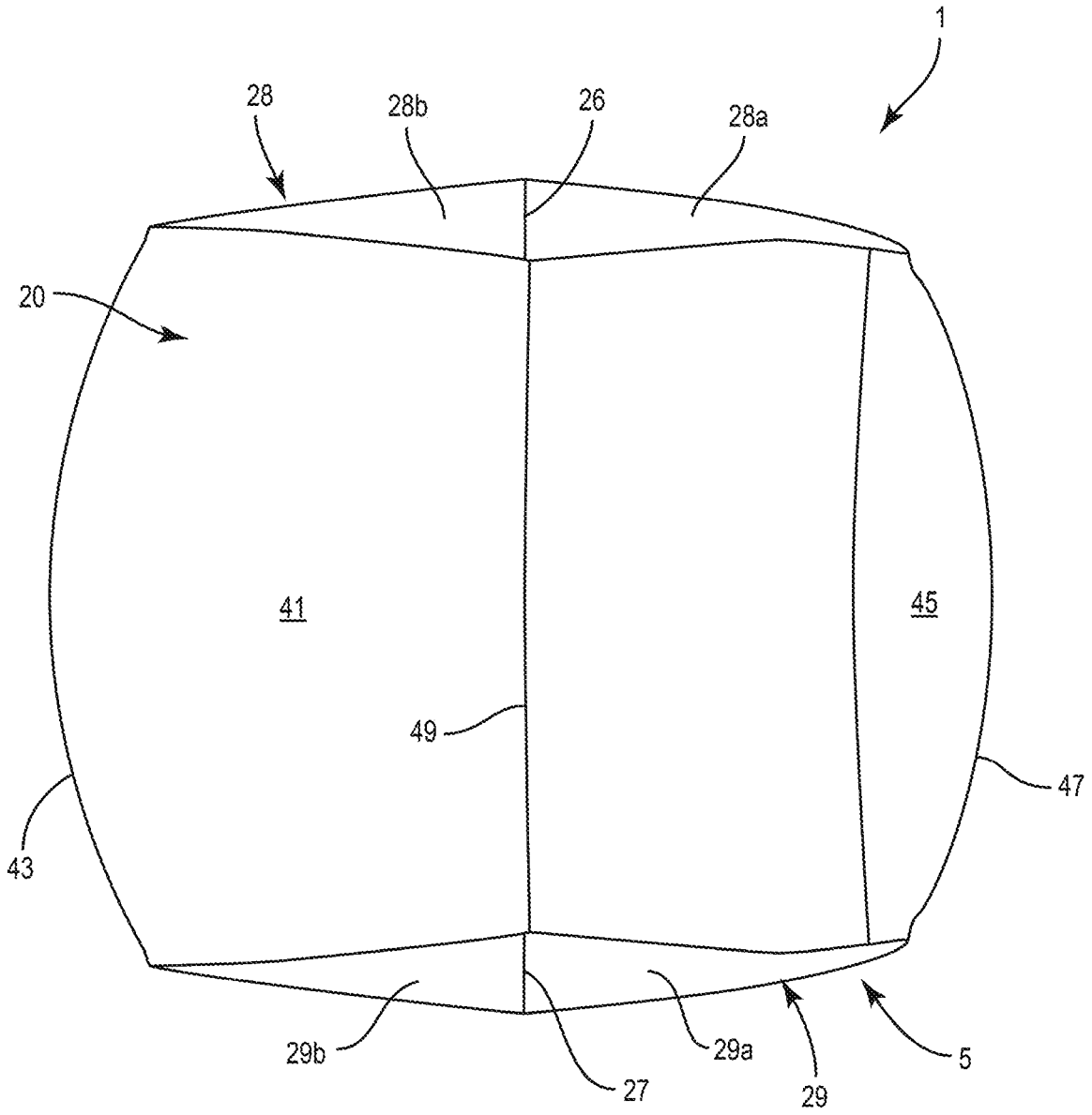
FIG. 9 is a bottom view of the package of FIGS. 6-8.
Figure 10:
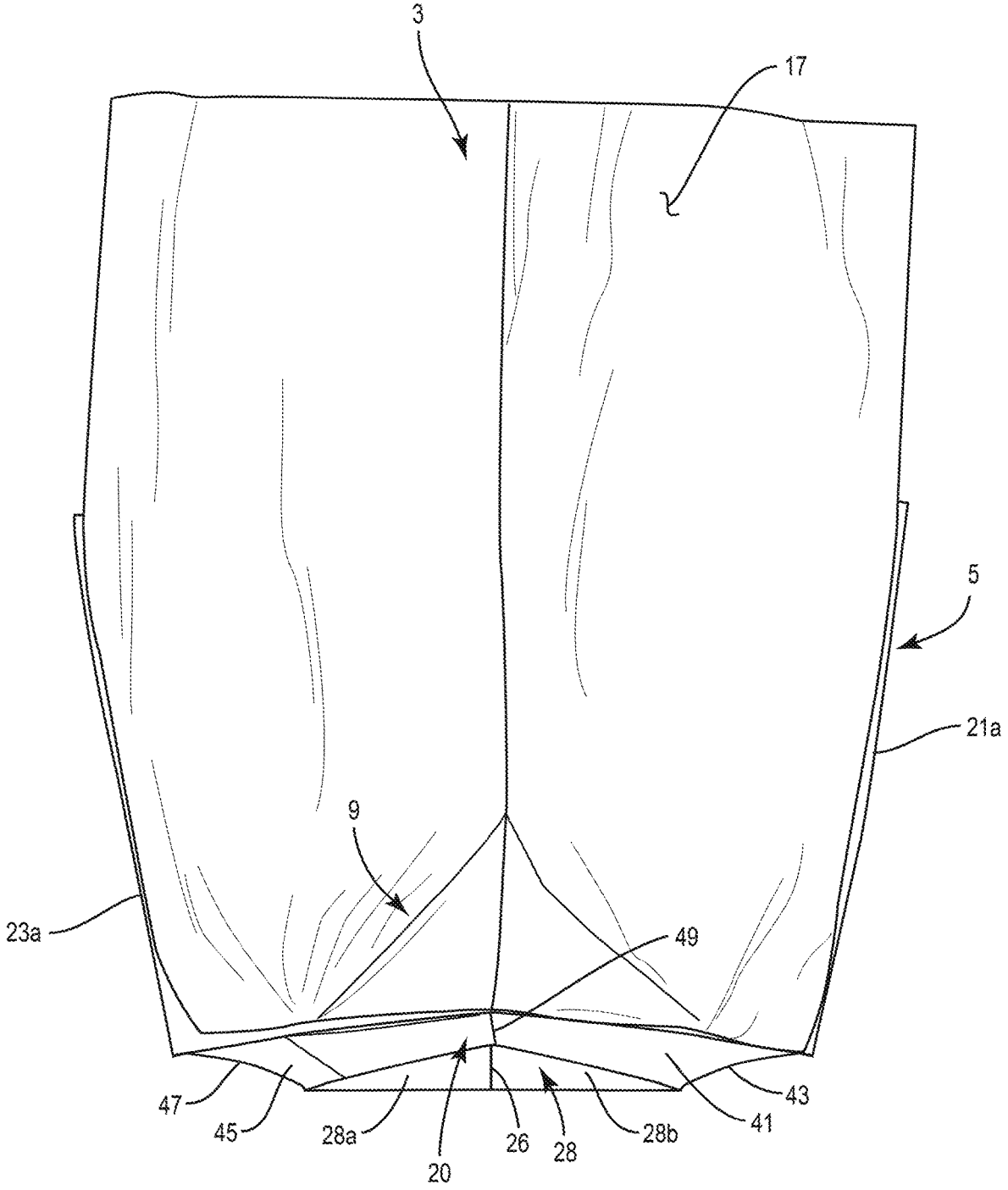
FIG. 10 is a cross-sectional view of the package of FIGS. 6-9.

As shown in FIGS. 8-10, the bottom panels 41, 45 can fold along the fold lines 43, 47, 49 as the carton 5 is moved to the erected configuration so that the bottom wall 20 (including the bottom panels 41, 45) extends across the bottom of the carton 5 between the center portions 21*a*, 23*a* (e.g., as shown in FIG. 10). In one embodiment, the curved fold lines 43, 47 connecting the bottom panels 41, 45 to the central portions 21*a*, 23*a* can be configured to allow the bottom 20 to shape open and remain open. Stated another way, the curved fold lines 43, 47 can help the carton 5 deform according to a predetermined shape that helps retain the carton 5 in the expanded configuration by resisting forces that would tend to push the central portions 21*a*, 23*a* inwardly and push the fold lines 26, 27 of the panels 28, 29 and the fold line 49 of the bottom panel 41 outwardly and collapse the carton 5. In one embodiment, the bottom 20 can be considered a bottom locking feature that snaps to the erected position (e.g., snaps the carton 5 open) when the fold line 49 is folded inwardly and retains the carton 5 in the erected configuration (e.g., due to the curved shape of the fold lines 43, 47). The package 1 could be otherwise moved from the collapsed configuration to the erected configuration without departing from the disclosure.

In the erect configuration of the package 1, the carton 5 can rest on the bottom edges 42 of the side panels 28, 29 so that the package 1 can be supported on a flat surface and positioned upright in the erect configuration to allow access to the interior space 17 through the top 7 of the bag 3 (FIG. 7). In an exemplary embodiment, the package 1 can hold and/or serve snack foods (e.g., cheese balls, popcorn, chips, pretzels, etc.) and/or other food items (not shown). In one exemplary embodiment, the sealed bottom 9 of the bag 3 can be a fluid-tight seal that allows a user to add water, milk, or other fluid to the interior 17 of the bag of the reinforced package 1 to combine with a food product (e.g., cereal, oatmeal, etc.) in the interior 17. In one embodiment, the package 1 can be placed in a microwave oven to heat the food product. Further, the package 1 can be used to hold other types of food products without departing from the disclosure.

In the illustrated embodiment, the package 1 can be moved from the erected configuration to the flattened configuration by folding the bottom panels 41, 45 outwardly along fold lines 43, 47, 49 and pressing the front panel 21 and the back panel 23 inwardly. As the carton 5 collapses, the side panels 28, 29 can fold outwardly along fold lines 26, 30, 31 and 27, 32, 33. The package 1 could be otherwise moved from the erected configuration to the flattened configuration without departing from the disclosure.

The package 1, carton 5, blank 10, and/or bag 3 could have other features or be otherwise shaped, arranged, and/or configured without departing from the disclosure.

Any of the features of the various embodiments of the disclosure can be combined with, replaced by, or otherwise configured with other features of other embodiments of the disclosure without departing from the scope of this disclosure.

Generally, as described herein, liners or bags can be formed from a paper stock material, although various plastic or other liner materials also can be used, and can be lined or coated with a desired material. The constructs, blanks, and/or reinforcing sleeves described herein can be made from a more rigid material such as a clay-coated natural kraft ("CCNK"). Other materials such various card-stock, paper, plastic or other synthetic or natural materials also can be used to form the components of the packages described herein.

In general, the blanks of the present disclosure may be constructed from paperboard having a caliper so that it is heavier and more rigid than ordinary paper. The blank can also be constructed of other materials, such as cardboard, or any other material having properties suitable for enabling the carton to function at least generally as described above. The blank can be coated with, for example, a clay coating. The clay coating may then be printed over with product, advertising, and other information or images. The blanks may then be coated with a varnish to protect information printed on the blanks. The blanks may also be coated with, for example, a moisture barrier layer, on either or both sides of the blanks. The blanks can also be laminated to or coated with one or more sheet-like materials at selected panels or panel sections.

As an example, a tear line can include: a slit that extends partially into the material along the desired line of weakness, and/or a series of spaced apart slits that extend partially into and/or completely through the material along the desired line of weakness, or various combinations of these features. As a more specific example, one type tear line is in the form of a series of spaced apart slits that extend completely through the material, with adjacent slits being spaced apart slightly so that a nick (e.g., a small somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous cut line. That is, it is within the scope of the present disclosure for each of the tear lines to be replaced with a continuous slit, or the like. For example, a cut line can be a continuous slit or could be wider than a slit without departing from the present disclosure.

In accordance with the exemplary embodiments, a fold line can be any substantially linear, although not necessarily straight, form of weakening that facilitates folding there along. More specifically, but not for the purpose of narrowing the scope of the present disclosure, fold lines include: a score line, such as lines formed with a blunt scoring knife, or the like, which creates a crushed or depressed portion in the material along the desired line of weakness; a cut that extends partially into a material along the desired line of weakness, and/or a series of cuts that extend partially into and/or completely through the material along the desired line of weakness; and various combinations of these features. In situations where cutting is used to create a fold line, typically the cutting will not be overly extensive in a manner that might cause a reasonable user to incorrectly consider the fold line to be a tear line.

The above embodiments may be described as having one or more panels adhered together by glue during erection of the carton embodiments. The term "glue" is intended to encompass all manner of adhesives commonly used to secure carton panels in place.

The foregoing description of the disclosure illustrates and describes various embodiments. As various changes could be made in the above construction without departing from the scope of the disclosure, it is intended that all matter contained in the above description or shown in the accompanying drawings shall be interpreted as illustrative and not in a limiting sense. Furthermore, the scope of the present disclosure covers various modifications, combinations, alterations, etc., of the above-described embodiments. Additionally, the disclosure shows and describes only selected embodiments, but various other combinations, modifications, and environments are within the scope of the disclosure as expressed herein, commensurate with the above teachings, and/or within the skill or knowledge of the relevant art. Furthermore, certain features and characteristics of each embodiment may be selectively interchanged and applied to other illustrated and non-illustrated embodiments of the disclosure.

What is claimed is:

1. A reinforced package, comprising:

a carton comprising a plurality of panels that extends at least partially around an interior of the carton, the plurality of panels comprising a front panel, a back panel disposed opposite to the front panel, and a side panel foldably connected to at least one of the front panel and the back panel, the side panel comprising a first panel portion foldably connected to a second panel portion along a lateral fold line, each of the first panel portion and the second panel portion being a triangle, and the carton comprising a bottom wall foldably connected to the front panel along a first curved fold line and to the back panel along a second curved fold line; and a bag at least partially attached to the carton, the bag at least partially defining an interior space for holding a product;

wherein the carton is positionable in a non-erect position wherein the interior space of the bag is at least partially collapsed and in an erect position wherein the interior space of the bag is increased, the carton is configured to support the bag in the erect position and at least the bottom wall and the first curved fold line are configured to retain the carton in the erect position.

2. The reinforced package of claim 1, wherein the second curved fold line is configured to retain the carton in the erect position along with at least the bottom wall and the first curved fold line.

3. The reinforced package of claim 1, wherein the bottom wall is foldable along at least the first curved fold line and the second curved fold line when moving the carton between the non-erect position and the erect position.

4. The reinforced package of claim 1, wherein a bottom fold line extends in the bottom wall and is spaced apart from the first curved fold line and the second curved fold line, and the bottom wall is foldable along at least the first curved fold line, the second curved fold line, and the bottom fold line when moving the carton between the non-erect position and the erect position.

5. The reinforced package of claim 4, wherein the bottom wall comprises a first bottom end flap foldably connected to the front panel along the first curved fold line and a second bottom end flap foldably connected to the back panel along the second curved fold line, and the first bottom end flap and the second bottom end flap are in an at least partially overlapped relationship to at least partially form the bottom wall.

6. The reinforced package of claim 5, wherein the bottom fold line extends in at least one of the first bottom end flap and the second bottom end flap.

7. The reinforced package of claim 1, wherein each of the first curved fold line and the second curved fold line is concave with respect to the bottom wall.

8. The reinforced package of claim 1, wherein the front panel comprises at least a front center portion foldably connected to a first front corner portion along a first oblique fold line and to a second front corner portion along a second oblique fold line.

9. The reinforced package of claim 8, wherein the back panel comprises at least a back center portion foldably connected to a first back corner portion along a third oblique fold line and to a second back corner portion along a fourth oblique fold line.

10. The reinforced package of claim 1, wherein the side panel is a first side panel, the lateral fold line is a first lateral fold line, the plurality of panels further comprises a second side panel foldably connected to at least one of the front panel and the back panel, the second side panel comprises a third panel portion foldably connected to a fourth panel portion along a second lateral fold line, and each of the third panel portion and the fourth panel portion is a triangle.

11. A reinforced package, comprising:

a carton comprising a plurality of panels that extends at least partially around an interior of the carton, the plurality of panels comprising a front panel and a back panel disposed opposite to the front panel, the carton comprising a bottom wall foldably connected to the front panel along a first curved fold line and to the back panel along a second curved fold line; and a bag at least partially attached to the carton, the bag at least partially defining an interior space for holding a product;

wherein the carton is positionable in a non-erect position wherein the interior space of the bag is at least partially collapsed and in an erect position wherein the interior space of the bag is increased, the carton is configured to support the bag in the erect position and at least the bottom wall and the first curved fold line are configured to retain the carton in the erect position;

wherein the front panel comprises at least a front center portion foldably connected to a first front corner portion along a first oblique fold line and to a second front corner portion along a second oblique fold line, and the first oblique fold line and the second oblique fold line at least partially converge at a top edge of the carton.

12. The reinforced package of claim 11, wherein the first oblique fold line and a first end of the first curved fold line at least partially converge, and the second oblique fold line and a second end of the first curved fold line at least partially converge.

13. The reinforced package of claim 11, wherein the plurality of panels further comprises a first side panel and a second side panel, the first front corner portion is foldably connected to the first side panel along a third oblique fold line, the second front corner portion is foldably connected to the second side panel along a fourth oblique fold line, the first oblique fold line, the third oblique fold line, and the first curved fold line at least partially converge, and the second oblique fold line, the fourth oblique fold line, and the first curved fold line at least partially converge.

14. The reinforced package of claim 13, wherein each of at least the first front corner portion, the second front corner portion, the first side panel, and the second side panel is a triangle.

15. A reinforced package, comprising:

a carton comprising a plurality of panels that extends at least partially around an interior of the carton, the plurality of panels comprising a front panel and a back panel disposed opposite to the front panel, the carton comprising a bottom wall foldably connected to the front panel along a first curved fold line and to the back panel along a second curved fold line; and a bag at least partially attached to the carton, the bag at least partially defining an interior space for holding a product;

wherein the carton is positionable in a non-erect position wherein the interior space of the bag is at least partially collapsed and in an erect position wherein the interior space of the bag is increased, the carton is configured to support the bag in the erect position and at least the bottom wall and the first curved fold line are configured to retain the carton in the erect position;

wherein the front panel comprises at least a front center portion foldably connected to a first front corner portion along a first oblique fold line and to a second front corner portion along a second oblique fold line, the back panel comprises at least a back center portion foldably connected to a first back corner portion along a third oblique fold line and to a second back corner portion along a fourth oblique fold line, the plurality of panels further comprises a side panel, the first front corner portion is foldably connected to the side panel along a fifth oblique fold line, the first back corner portion is foldably connected to the side panel along a sixth oblique fold line, and the fifth oblique fold line and the sixth oblique fold line converge at a top edge of the carton.

16. In combination, carton blank and a bag for forming a reinforced package for holding a product:

the carton blank being for forming a carton, the carton blank comprising a plurality of panels comprising a front panel, a back panel, and a side panel foldably connected to at least one of the front panel and the back panel, the side panel comprising a first panel portion foldably connected to a second panel portion along a lateral fold line, each of the first panel portion and the second panel portion being a triangle, and the carton blank comprising a first bottom end flap foldably connected to the front panel along a first curved fold line and a second bottom end flap foldably connected to the back panel along a second curved fold line, the first bottom end flap and the second bottom end flap at least partially forming a bottom wall when the carton is formed from the carton blank;

a bag at least partially attached to the carton blank, the bag at least partially defining an interior space for holding a product;

wherein the carton formed from the carton blank is positionable in a non-erect position wherein the interior space of the bag is at least partially collapsed and in an erect position wherein the interior space of the bag is increased when the reinforced package is formed from the carton blank and the bag, the carton formed from the carton blank is configured to support the bag in the erect position when the reinforced package is formed from the carton blank and the bag, and at least the bottom wall and the first curved fold line are configured to retain the carton in the erect position when the reinforced package is formed from the carton blank and the bag.

17. The combination of claim 16, wherein the second curved fold line is configured to retain the carton in the erect position along with at least the bottom wall and the first curved fold line when the reinforced package is formed from the carton blank and the bag.

18. The combination of claim 16, wherein, when the reinforced package is formed from the carton blank and the bag, the bottom wall is foldable along at least the first curved fold line and the second curved fold line when moving the carton formed from the carton blank between the non-erect position and the erect position.

19. The combination of claim 16, wherein a bottom fold line extends in at least one of the first bottom end flap and the second bottom end flap, the bottom fold line is spaced apart from the first curved fold line and the second curved fold line, and, when the reinforced package is formed from the carton blank and the bag, the bottom wall is foldable along at least the first curved fold line, the second curved fold line, and the bottom fold line when moving the carton formed from the carton blank between the non-erect position and the erect position.

20. The combination of claim 16, wherein the first curved fold line is concave with respect to the first bottom end flap and the second curved fold line is concave with respect to the second bottom end flap.

21. The combination of claim 16, wherein the front panel comprises at least a front center portion foldably connected to a first front corner portion along a first oblique fold line and to a second front corner portion along a second oblique fold line.

22. The combination of claim 21, wherein the back panel comprises at least a back center portion foldably connected to a first back corner portion along a third oblique fold line and to a second back corner portion along a fourth oblique fold line.

23. The combination of claim 16, wherein the side panel is a first side panel, the lateral fold line is a first lateral fold line, the plurality of panels further comprises a second side panel foldably connected to at least one of the front panel and the back panel, the second side panel comprises a third panel portion foldably connected to a fourth panel portion along a second lateral fold line, and each of the third panel portion and the fourth panel portion is a triangle.

24. In combination, carton blank and a bag for forming a reinforced package for holding a product:

the carton blank being for forming a carton, the carton blank comprising a plurality of panels comprising a front panel and a back panel, the carton blank comprising a first bottom end flap foldably connected to the front panel along a first curved fold line and a second bottom end flap foldably connected to the back panel along a second curved fold line, the first bottom end flap and the second bottom end flap at least partially forming a bottom wall when the carton is formed from the carton blank;

a bag at least partially attached to the carton blank, the bag at least partially defining an interior space for holding a product;

wherein the carton formed from the carton blank is positionable in a non-erect position wherein the interior space of the bag is at least partially collapsed and in an erect position wherein the interior space of the bag is increased when the reinforced package is formed from the carton blank and the bag, the carton formed from the carton blank is configured to support the bag in the erect position when the reinforced package is formed from the carton blank and the bag, and at least the bottom wall and the first curved fold line are configured to retain the carton in the erect position when the reinforced package is formed from the carton blank and the bag;

wherein the front panel comprises at least a front center portion foldably connected to a first front corner portion along a first oblique fold line and to a second front corner portion along a second oblique fold line, and the first oblique fold line and the second oblique fold line at least partially converge at a top edge of the carton blank.

25. The combination of claim 24, wherein the first oblique fold line and a first end of the first curved fold line at least partially converge, and the second oblique fold line and a second end of the first curved fold line at least partially converge.

26. The combination of claim 24, wherein the plurality of panels further comprises a first side panel and a second side panel, the first front corner portion is foldably connected to the first side panel along a third oblique fold line, the second front corner portion is foldably connected to the second side panel along a fourth oblique fold line, the first oblique fold line, the third oblique fold line, and the first curved fold line at least partially converge, and the second oblique fold line, the fourth oblique fold line, and the first curved fold line at least partially converge.

27. The combination of claim 26, wherein each of at least the first front corner portion, the second front corner portion, the first side panel, and the second side panel is a triangle.

28. In combination, carton blank and a bag for forming a reinforced package for holding a product:

the carton blank being for forming a carton, the carton blank comprising a plurality of panels comprising a front panel and a back panel, the carton blank comprising a first bottom end flap foldably connected to the front panel along a first curved fold line and a second bottom end flap foldably connected to the back panel along a second curved fold line, the first bottom end flap and the second bottom end flap at least partially forming a bottom wall when the carton is formed from the carton blank;

a bag at least partially attached to the carton blank, the bag at least partially defining an interior space for holding a product;

wherein the carton formed from the carton blank is positionable in a non-erect position wherein the interior space of the bag is at least partially collapsed and in an erect position wherein the interior space of the bag is increased when the reinforced package is formed from the carton blank and the bag, the carton formed from the carton blank is configured to support the bag in the erect position when the reinforced package is formed from the carton blank and the bag, and at least the bottom wall and the first curved fold line are configured to retain the carton in the erect position when the reinforced package is formed from the carton blank and the bag;

wherein the front panel comprises at least a front center portion foldably connected to a first front corner portion along a first oblique fold line and to a second front corner portion along a second oblique fold line, the back panel comprises at least a back center portion foldably connected to a first back corner portion along a third oblique fold line and to a second back corner portion along a fourth oblique fold line, the plurality of panels further comprises a side panel, the first front corner portion is foldably connected to the side panel along a fifth oblique fold line, the first back corner portion is foldably connected to the side panel along a sixth oblique fold line, and the fifth oblique fold line and the sixth oblique fold line converge at a top edge of the carton.

29. A method for forming a reinforced package for holding a product, the method comprising:

obtaining a carton blank comprising a plurality of panels comprising a front panel, a back panel, and a side panel foldably connected to at least one of the front panel and the back panel, the side panel comprising a first panel portion foldably connected to a second panel portion along a lateral fold line, each of the first panel portion and the second panel portion being a triangle, and the carton blank comprising a first bottom end flap foldably connected to the front panel along a first curved fold line and a second bottom end flap foldably connected to the back panel along a second curved fold line;

forming a bag at least partially attached to the carton blank, the bag at least partially defining an interior space for holding a product; and forming an interior of a carton at least partially defined by the plurality of panels with the back panel disposed opposite to the front panel, the forming the interior of the carton comprising forming a bottom wall comprising the first bottom end flap and the second bottom end flap;

wherein the carton is positionable in a non-erect position wherein the interior space of the bag is at least partially collapsed and in an erect position wherein the interior space of the bag is increased, the carton is configured to support the bag in the erect position and at least the bottom wall and the first curved fold line are configured to retain the carton in the erect position.

30. The method of claim 29, wherein the second curved fold line is configured to retain the carton in the erect position along with at least the bottom wall and the first curved fold line.

31. The method of claim 29, wherein a bottom fold line extends in the bottom wall and is spaced apart from the first curved fold line and the second curved fold line, and moving the carton between the non-erect position and the erect position comprises folding the bottom wall along at least the first curved fold line, the second curved fold line, and the bottom fold line.

32. The method of claim 29, wherein each of the first curved fold line and the second curved fold line is concave with respect to the bottom wall.

33. A method for forming a reinforced package for holding a product, the method comprising:

obtaining a carton blank comprising a plurality of panels comprising a front panel and a back panel, the carton blank comprising a first bottom end flap foldably connected to the front panel along a first curved fold line and a second bottom end flap foldably connected to the back panel along a second curved fold line, wherein the front panel comprises at least a front center portion foldably connected to a first front corner portion along a first oblique fold line and to a second front corner portion along a second oblique fold line, and the first oblique fold line and the second oblique fold line at least partially converge at a top edge of the carton;

forming a bag at least partially attached to the carton blank, the bag at least partially defining an interior space for holding a product; and forming an interior of a carton at least partially defined by the plurality of panels with the back panel disposed opposite to the front panel, the forming the interior of the carton comprising forming a bottom wall comprising the first bottom end flap and the second bottom end flap;

wherein the carton is positionable in a non-erect position wherein the interior space of the bag is at least partially collapsed and in an erect position wherein the interior space of the bag is increased, the carton is configured to support the bag in the erect position and at least the bottom wall and the first curved fold line are configured to retain the carton in the erect position.

* * * * *